US008840008B2

(12) United States Patent
Burton

(10) Patent No.: US 8,840,008 B2
(45) Date of Patent: Sep. 23, 2014

(54) CUP SCOOP AND CONTAINER FOR FOOD PRODUCTS OR THE LIKE

(75) Inventor: Jack Burton, Paris, TX (US)

(73) Assignee: Huhtamaki, Inc., De Soto, KS (US)

( * ) Notice: Subject to any disclaimer, the term of this patent is extended or adjusted under 35 U.S.C. 154(b) by 0 days.

(21) Appl. No.: 13/594,852

(22) Filed: Aug. 26, 2012

(65) Prior Publication Data

US 2013/0048702 A1 Feb. 28, 2013

Related U.S. Application Data

(60) Provisional application No. 61/527,809, filed on Aug. 26, 2011.

(51) Int. Cl.
*B65D 5/42* (2006.01)
*B65D 5/00* (2006.01)

(52) U.S. Cl.
CPC ... *B65D 5/00* (2013.01); *B65D 5/42* (2013.01)
USPC ..... 229/108; 229/100

(58) Field of Classification Search
CPC .... Y10S 229/906; B65D 5/3685; B65D 5/18; B65D 3/06; B65D 3/08; B65D 5/0209
USPC ..... 229/100, 108, 902, 117.05, 405
See application file for complete search history.

(56) References Cited

U.S. PATENT DOCUMENTS

| | | | | |
|---|---|---|---|---|
| 677,017 | A | 6/1901 | Carrington | |
| 1,478,838 | A * | 12/1923 | Reifsnyder | 229/400 |
| 2,112,959 | A | 4/1938 | Harvey | |
| 2,168,186 | A | 8/1939 | Adamson | |
| 2,385,898 | A * | 10/1945 | Waters | 229/117.03 |
| 2,761,448 | A | 9/1956 | Monroe | |
| 2,925,208 | A | 2/1960 | Wood | |
| 3,381,877 | A | 5/1968 | Arneson | |
| 3,580,473 | A | 5/1971 | Gill | |
| 3,630,430 | A | 12/1971 | Struble | |
| 3,684,157 | A | 8/1972 | Mendez | |
| 3,827,623 | A | 8/1974 | Arneson | |
| 3,845,897 | A | 11/1974 | Buttery | |
| 3,877,632 | A | 4/1975 | Steel | |

(Continued)

FOREIGN PATENT DOCUMENTS

| | | |
|---|---|---|
| DE | 2431666 A1 | 1/1975 |
| DE | 7737542 U1 | 4/1978 |

(Continued)

*Primary Examiner* — Gary Elkins
*Assistant Examiner* — Christopher Demeree
(74) *Attorney, Agent, or Firm* — Husch Blackwell LLP

(57) ABSTRACT

A one piece container or scoop adapted for holding and serving food products and the like is provided. The container generally comprises front and rear wall panels foldably joined to a bottom wall panel. Side edge portions of the front and rear wall panels are adhesively bonded in a generally overlapping relationship to form a sidewall having opposed side seams. Lines provided on one or both of the front and rear wall panels aid in ensuring that the scoop is properly aligned with and formed around a forming head. Other marker lines are provided as visual indicators to ensure that the intended amount of overlap is achieved between the front and rear wall panels. Internal tabs extending upwardly from the bottom wall may be provided in order to seal the bottom of the scoop. Such tabs are configured so as to require not glue or adhesive.

2 Claims, 7 Drawing Sheets

(56) References Cited

U.S. PATENT DOCUMENTS

| | | | | |
|---|---|---|---|---|
| 3,931,385 | A | | 1/1976 | Sutch |
| 4,020,988 | A | | 5/1977 | Kipp |
| 4,074,849 | A | | 2/1978 | Davidsson et al. |
| 4,185,764 | A | | 1/1980 | Cote |
| 4,210,271 | A | | 7/1980 | Dutcher |
| 4,252,264 | A | | 2/1981 | Herbst et al. |
| 4,267,955 | A | | 5/1981 | Struble |
| 4,410,129 | A | | 10/1983 | Wischusen, III |
| 4,470,540 | A | * | 9/1984 | Koltz ..... 229/109 |
| 4,502,623 | A | | 3/1985 | Moore, Jr. et al. |
| 4,552,293 | A | | 11/1985 | Blagg et al. |
| 4,619,637 | A | | 10/1986 | Jones |
| 4,711,389 | A | | 12/1987 | Alba et al. |
| 4,718,595 | A | | 1/1988 | Jones |
| D295,133 | S | | 4/1988 | Jones |
| 4,850,509 | A | | 7/1989 | Hollenberg |
| 4,915,235 | A | | 4/1990 | Roosa |
| 5,301,870 | A | | 4/1994 | Smith et al. |
| 5,720,428 | A | | 2/1998 | Jensen |
| 5,720,429 | A | | 2/1998 | Cordle |
| 5,875,957 | A | | 3/1999 | Yocum |
| 5,890,648 | A | | 4/1999 | Cai |
| 5,980,442 | A | | 11/1999 | Hamilton et al. |
| 6,050,482 | A | | 4/2000 | Cai |
| 6,053,403 | A | | 4/2000 | Cai |
| 6,216,946 | B1 | | 4/2001 | Cai |
| 6,471,119 | B2 | | 10/2002 | Cai |
| 6,513,704 | B1 | * | 2/2003 | Perot ..... 229/104 |
| 6,561,414 | B1 | | 5/2003 | Cai |
| 6,634,547 | B2 | * | 10/2003 | Willis ..... 229/405 |
| 6,719,190 | B2 | | 4/2004 | Yocum |
| 7,273,162 | B2 | | 9/2007 | Baker |
| 7,631,800 | B2 | | 12/2009 | Cai et al. |
| 2005/0045708 | A1 | | 3/2005 | Bodary et al. |
| 2008/0110966 | A1 | | 5/2008 | Yocum |
| 2011/0315753 | A1 | | 12/2011 | Learn |
| 2012/0000972 | A1 | | 1/2012 | Learn |

FOREIGN PATENT DOCUMENTS

| | | | |
|---|---|---|---|
| DE | 29621547 | U1 | 4/1998 |
| FR | 2444617 | A1 | 7/1980 |
| FR | 2729642 | A1 | 7/1996 |
| FR | 2746765 | A1 | 10/1997 |
| GB | 2028770 | A | 3/1980 |
| GB | 2087357 | A | 5/1982 |
| GB | 2305354 | A | 4/1997 |
| JP | 51059580 | A | 5/1976 |
| JP | 53131933 | U | 10/1978 |
| JP | 3030832 | U | 11/1996 |
| JP | 9-24924 | A | 1/1997 |
| JP | 3036402 | U | 4/1997 |
| JP | 9-226740 | A | 9/1997 |
| JP | 9-301336 | A | 11/1997 |
| JP | 3046013 | U | 2/1998 |
| JP | 3051644 | U | 9/1998 |

* cited by examiner

CUP SCOOP AND CONTAINER FOR FOOD PRODUCTS OR THE LIKE

CROSS-REFERENCE TO RELATED APPLICATIONS

This Application claims priority to U.S. Provisional Patent Application Ser. No. 61/527,809 filed Aug. 26, 2011 to Jack Burton entitled "Cup Scoop and Container for a Food Product or the Like," the entire disclosure of which is incorporated herein by reference.

BACKGROUND OF THE INVENTION

Folded and bonded paperboard, corrugated cardboard and foam scoops and containers are often used in the fast food and quick serve restaurant industry, for example. Advantageously, such scoops and containers are relatively simple and inexpensive to manufacture, assemble, ship, store and use, and are typically disposable. Often, it is desirable for these scoops to be stacked one on top of the other during shipment, storage and dispensing. When the scoops are stacked, it is desirable that they become fully nested one within the other. If the scoops are not fully nested, the stack of scoops will take up more space than necessary and may become unstable. Additionally, it can result in multiple scoops sticking together when a user intends to grab only one scoop from the stack. Any small variation in size or shape among the scoops can lead to them not fully nesting and can also result in interferences that lead to difficulty in removing just one scoop from the stack.

Additionally, it is desirable for scoops, especially those used for holding food products, to include a generally sealed bottom so as to prevent food, dressings and seasonings placed thereon from escaping through the bottom of the scoop. Because scoops are typically manufactured in the hundreds of thousands, incremental decreases in materials and glue and increased efficiency in handling and use may lead to significant cost savings.

Thus, a need exists for a scoop that can be produced in high volumes while maintaining tolerances of manufacture that result in the scoops being of precisely the same size and shape. A need also exists for a scoop having a generally sealed bottom that can be produced with minimal amounts of material and glue in order to promote cost savings.

SUMMARY OF THE INVENTION

The present invention involves the provision of a container or scoop comprising a generally cylindrical or frustoconical sidewall. The sidewall is formed from a front wall panel and a rear wall panel, each having side edge portions that are adhesively bonded in a generally overlapping relationship to form opposed side seams. The front and rear wall panels and an adjoining bottom panel may be constructed of a single piece of material and formed into shape around a forming head to produce the scoop.

In order to ensure that the scoop (and the blank of material the scoop is made from) is properly positioned on the forming head, the scoop may include generally vertical lines located on either one or both of the front and rear wall panels. The lines may be marked, etched, embossed, scored or otherwise included on the wall panels such that they are visible on the outer surfaces of the panels. The forming head can include corresponding lines, notches or other visual indicators that align with the lines on the front and rear wall panels of the scoop when the blank (and resulting scoop) are properly placed on the forming head. If improper alignment occurs, the scoops can take on an unintended shape, which has adverse impacts, especially when the scoops are stacked or nested. The lines provide a visual indicator to a human, optical device or other electronic sensor to ensure that the scoops are being properly formed around the forming head.

The scoop may also comprise lines adjacent an area where the front and rear wall panels overlap to provide a visual indicator that an intended amount of overlap is being achieved. If an improper amount of overlap occurs, the scoop can take on an unintended shape, which again has adverse impacts, especially when the scoops are stacked or nested.

In one embodiment, the scoop includes internal flaps or tabs extending upwardly from the bottom wall panel. The tabs are in contact with and are seated against the inner surfaces of the front and/or rear wall panels. When pressed against the wall panels, the tabs generally seal any gap or space between the wall panels and bottom panel located under the tabs.

The present invention also involves the provision of a blank adapted for constructing the scoop.

Other and further objects of the invention, together with the features of novelty appurtenant thereto, will appear in the course of the following description.

DESCRIPTION OF THE SEVERAL VIEWS OF THE DRAWINGS

In the accompanying drawings, which form a part of the specification and are to be read in conjunction therewith in which like reference numerals are used to indicate like or similar parts in the various views.

DETAILED DESCRIPTION OF THE INVENTION

Figure 1:
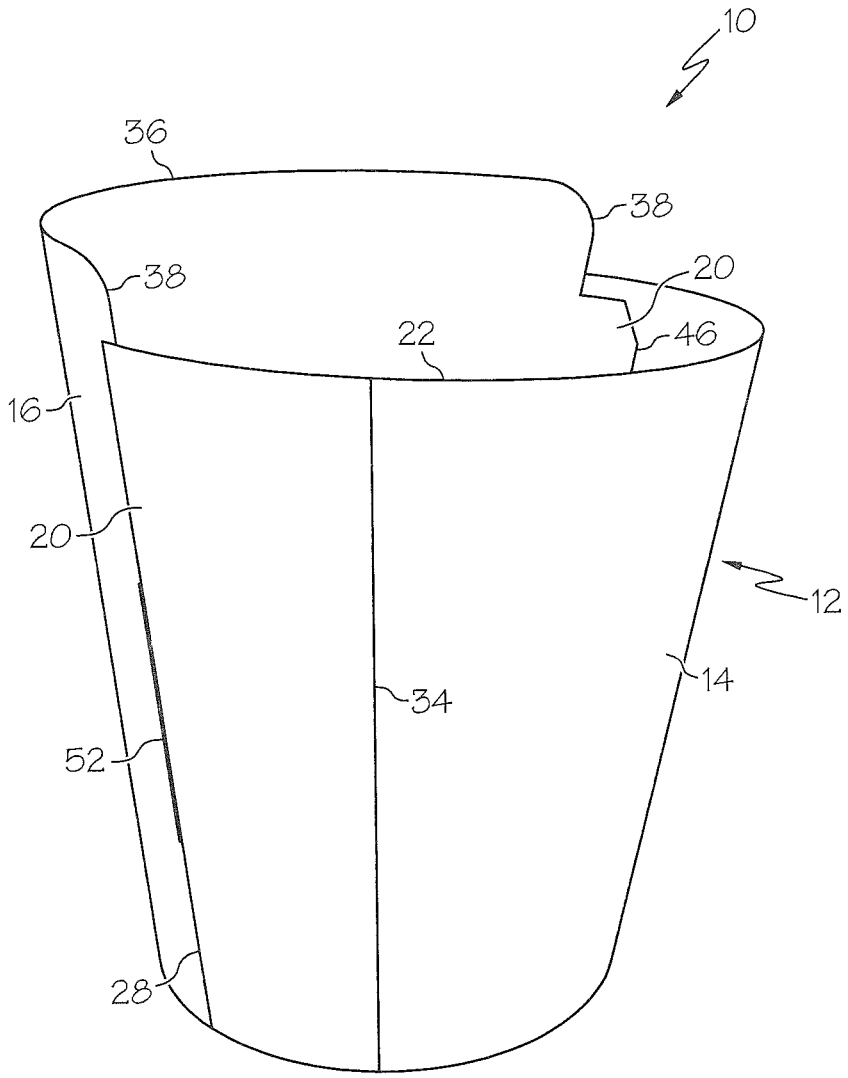
FIG. 1 is a side perspective of a scoop in accordance with one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The container or scoop 10 of the present invention includes an upright peripheral sidewall 12, which may be of a generally cylindrical configuration and, in one embodiment, takes on a generally frustoconical shape increasing in cross section from a lower end to an upper end. The lower end of the scoop 10 may have a substantially rectangular, polygonal, reuleaux polygonal, oval, circular or similar cross section and the upper end of the scoop 10 may have a generally oval or circular cross section. As illustrated, the sidewall 12 is formed from a front wall panel 14 and a rear wall panel 16, each having side edge portions 32 and 48 that are adhesively bonded in a generally overlapping relationship to form opposed side seams 20.

Figure 5:
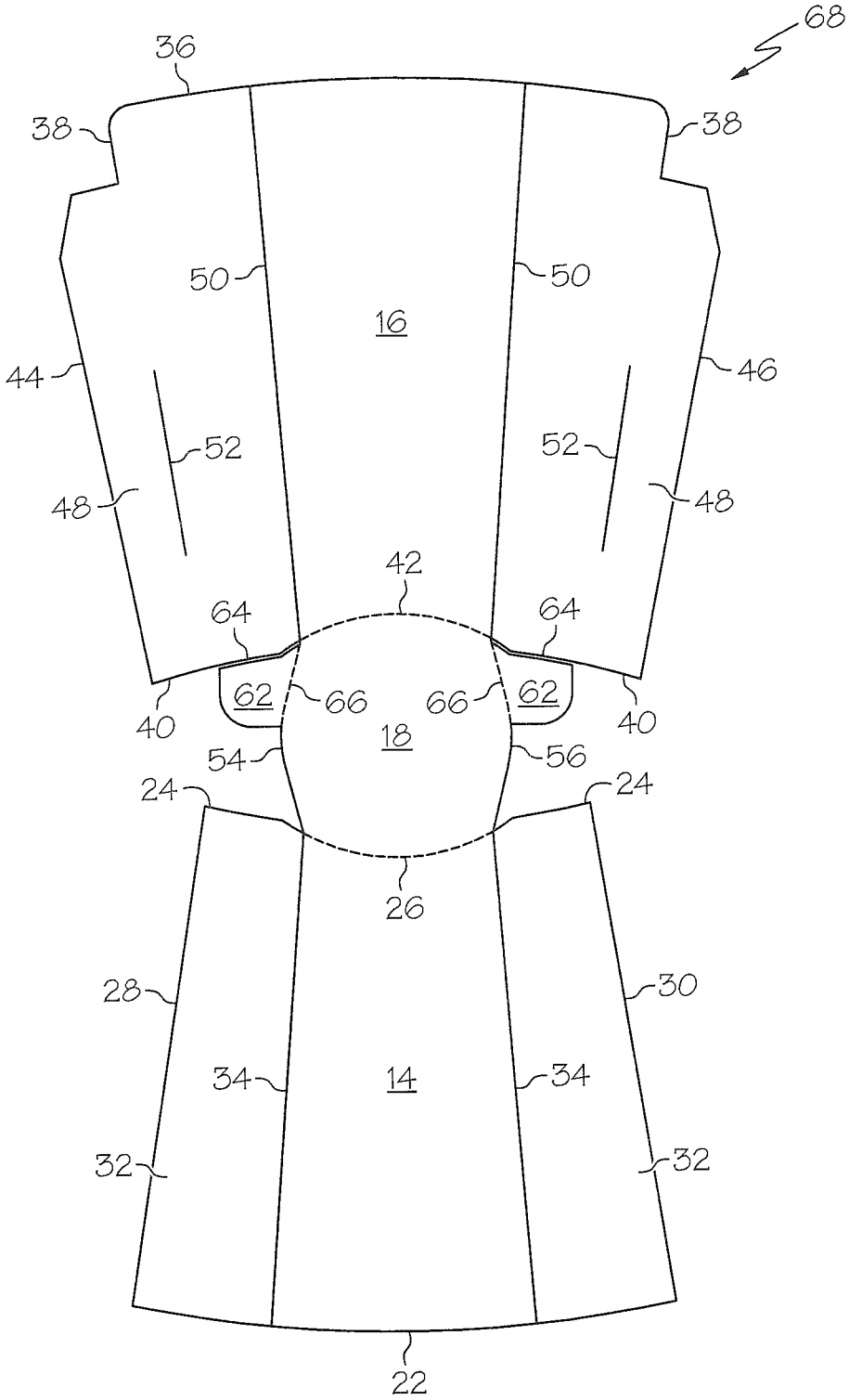
FIG. 5 is a plan view of a blank of material adapted to form a scoop in accordance with one embodiment of the present invention.
Figure 6:
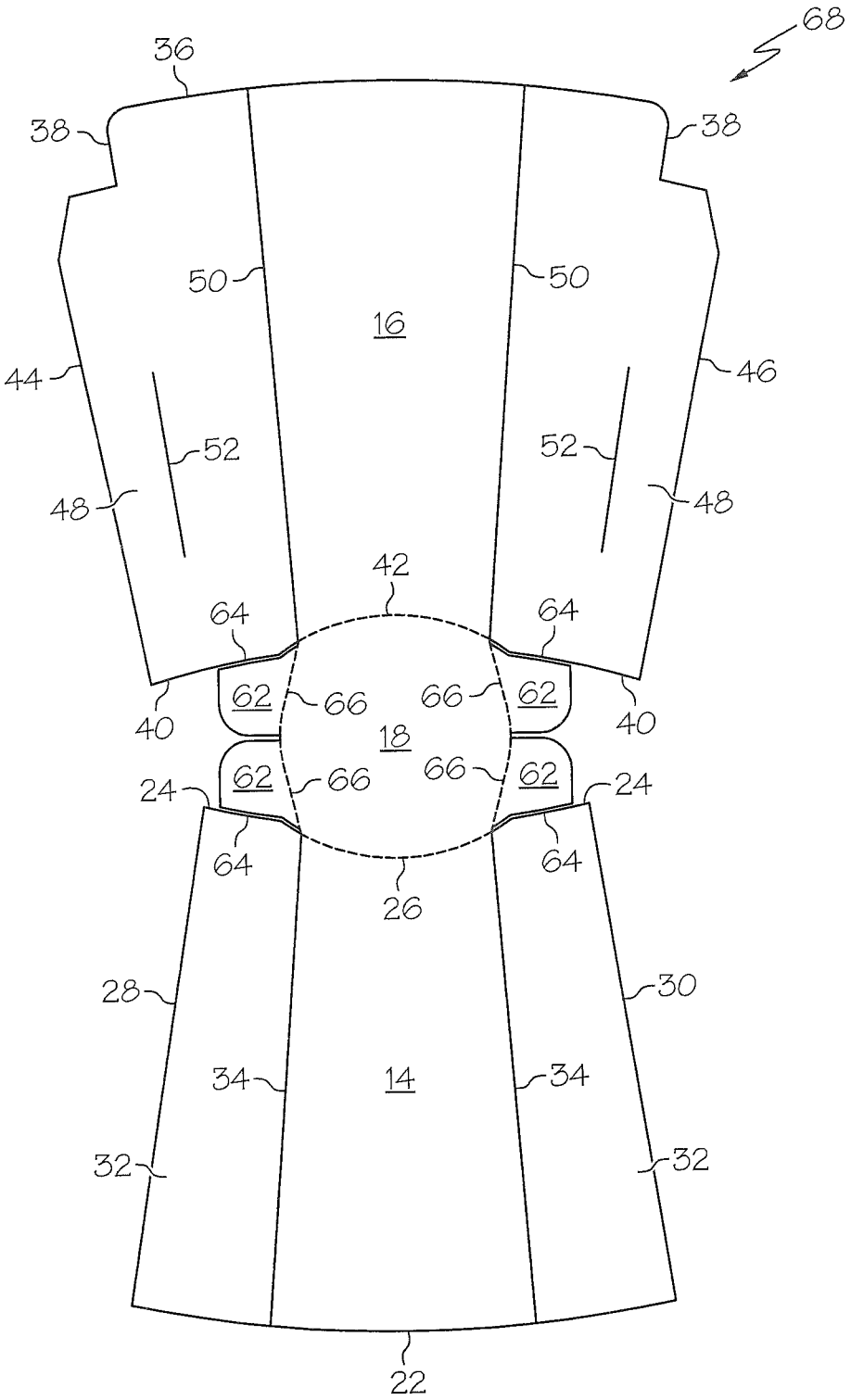
FIG. 6 is a plan view of another blank of material adapted to form a scoop in accordance with one embodiment of the present invention.
Figure 7:
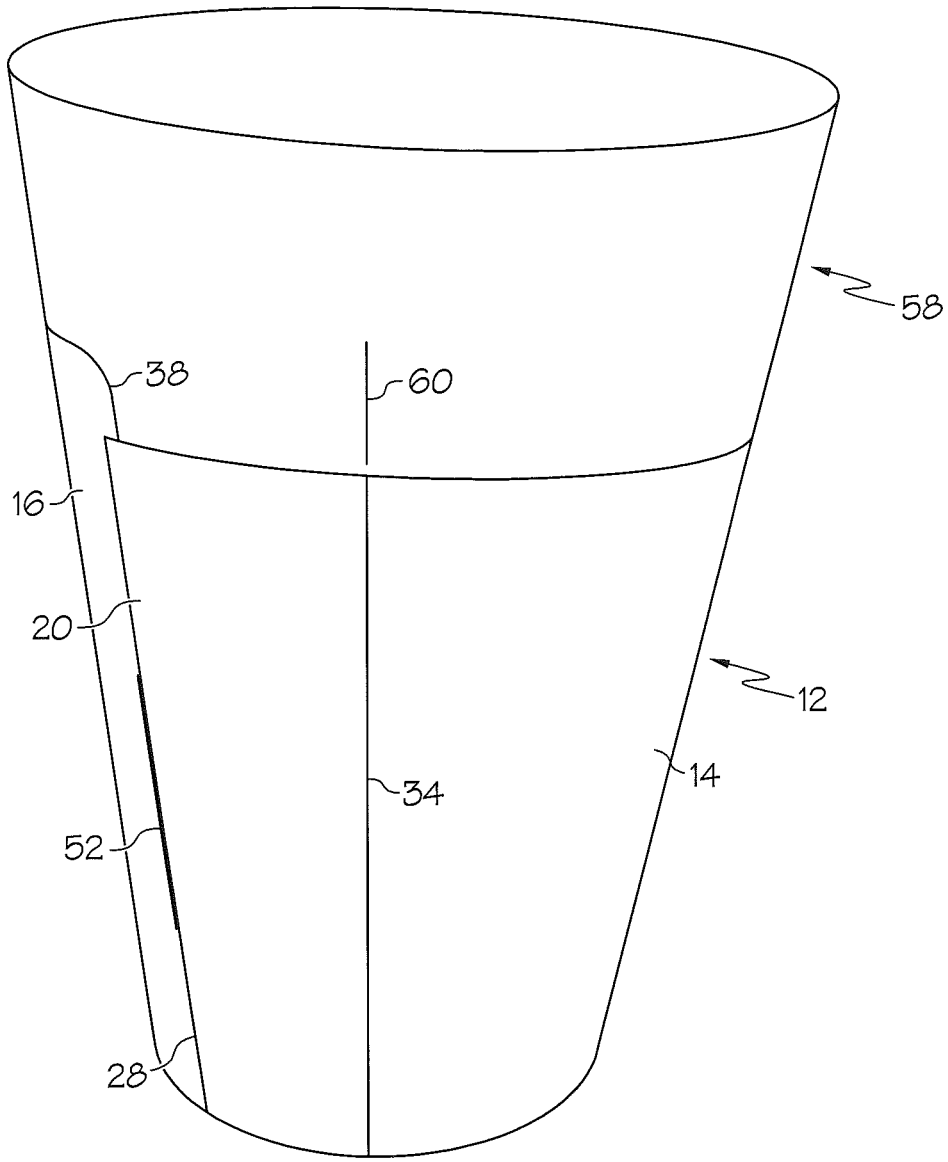
FIG. 7 is a side perspective of a scoop positioned around a forming head in accordance with one embodiment of the present invention.

The front wall panel 14 includes a top edge 22, a bottom edge 24 and opposing side edges 28 and 30. Likewise, the rear wall panel 16 can include a top edge 36 having rounded corners 38, a bottom edge 40 and opposing side edges 44 and 46. The top edges 22 and 36 of the front and rear wall panels 14 and 16 may be generally flat or horizontal when the scoop 10 is formed. In order to achieve such flat top edges 22 and 36, the edges 22 and 36 in the blank of material 68 used on constructing the scoop 10 are initially cut as having a slight outward curvature or bow, as depicted in FIGS. 5 and 6. When the blank 68 is formed into a generally cylindrical shape, the edges 22 and 36 become flat due to the outward curvature and semi-cylindrical orientation of the front and rear wall panels 14 and 16.

Figure 2:
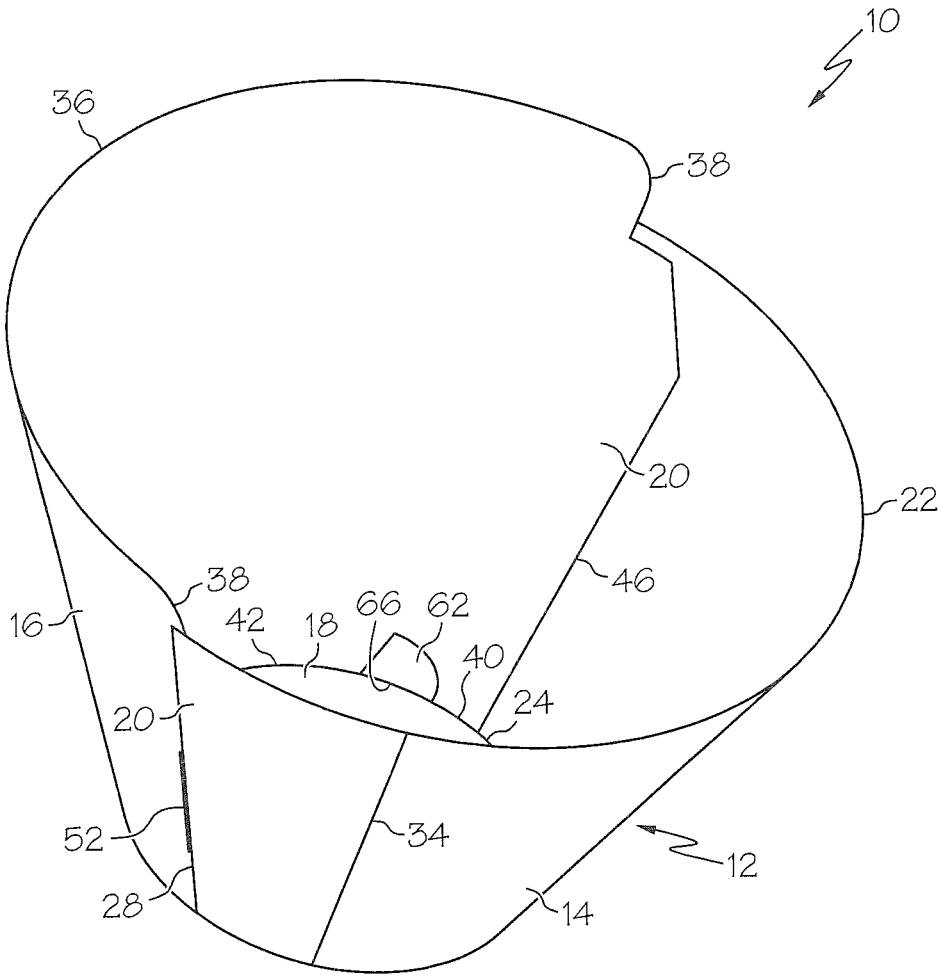
FIG. 2 is a top perspective view of a scoop in accordance with one embodiment of the present invention.
Figure 3:
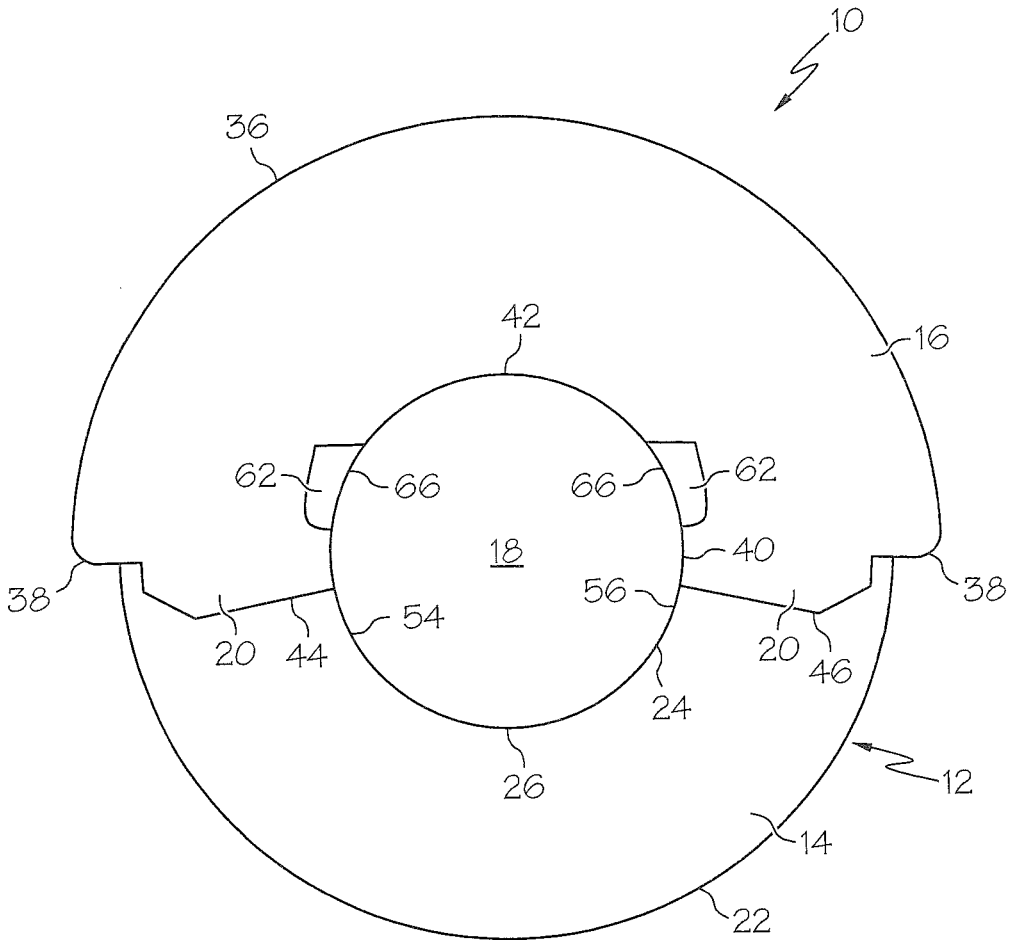
FIG. 3 is a top plan view of a scoop in accordance with one embodiment of the present invention.
Figure 4:
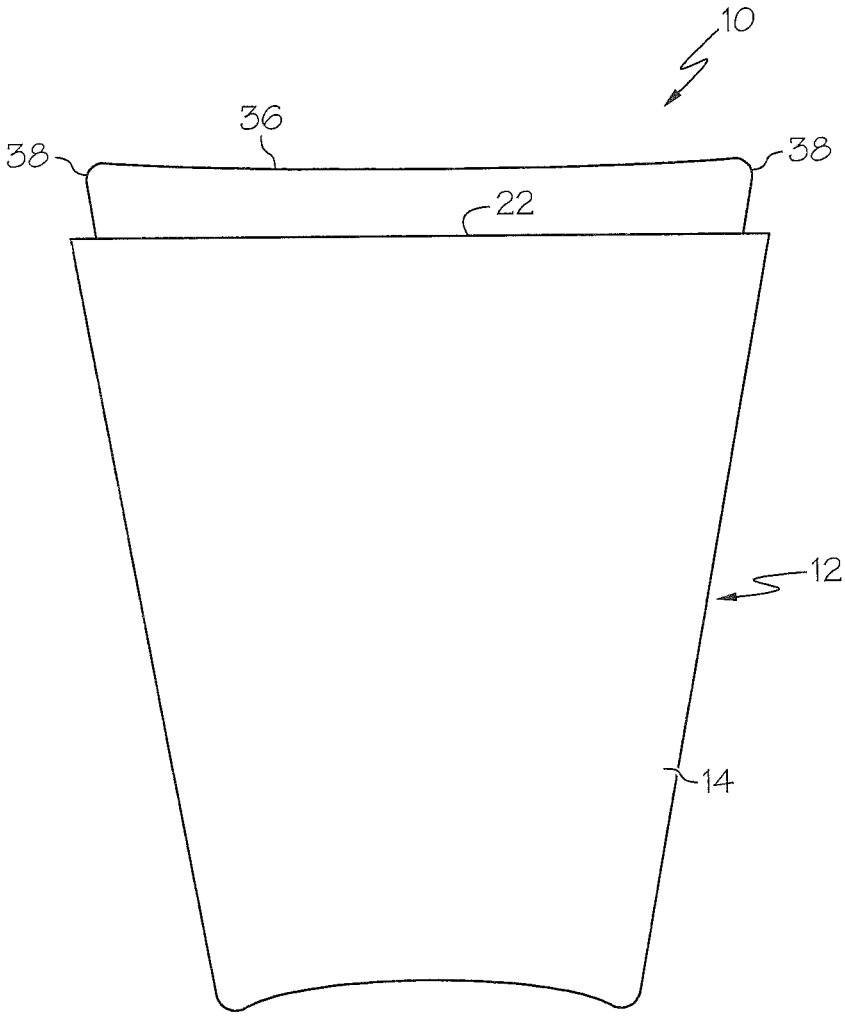
FIG. 4 is a front view of a scoop in accordance with one embodiment of the present invention.

Bottom edges 24 and 40 of front and rear panels 14 and 16 can be foldably joined to a bottom panel 18 in folded areas 26 and 42, as best shown in FIGS. 5 and 6. The bottom panel 18 serves to close off the lower end of the scoop 10, as illustrated in FIGS. 2 and 3. The front wall panel 14, rear wall panel 16 and bottom panel 18 may be formed from a single piece of material or blank 68.

Front and rear wall panels 14 and 16 may optionally include one or more generally vertical lines 34 and 50. Lines 34 and 50 may be marked, etched, embossed, scored or otherwise included thereon such that they are visible on the outer surfaces of the panels 14 and 16. Lines 34 and 50 are particularly useful in embodiments where the scoop 10 is formed around a forming head 58 or die. Portions of the scoop 10 in some embodiments (e.g., its lower end) may not be circular in cross section. In these embodiments, as the blank 68 is formed around a forming head 58, it is required that the blank 68 be properly positioned relative to the forming head 58, particularly about its longitudinal or vertical axis. Any movement or rotation of the scoop 10 about its longitudinal or vertical axis will result in the scoop 10 having an unintended shape. Misalignment of the blank 68 about the forming head 58 will result in scoops 10 of unintended shape. Even extremely small variations in the scoops' 10 shape can result in the scoops 10 not fully nesting one within the other when they are stacked. Additionally, these variations in shape can cause two or more scoops 10 to become stuck or wedged together after they have been stacked due to the interference fit that results when two or more differently-shaped scoops 10 are inserted one within the other. Thus, multiple scoops 10 can stick together when a user intends to grab only one scoop 10 from the stack.

Lines 34 and 50 can serve as visual indicators to ensure that the scoop 10 is properly positioned and formed around the forming head 58, particularly about its longitudinal or vertical axis. The forming head 58 can include lines 60, notches, lasers or other visual indicators that align with lines 34 and 50 when the scoop front and rear wall panels 14 and 16 are properly positioned about the forming head 58. Because scoops 10 are normally produced in very large quantities, they are typically formed using high-speed automated machinery. When the machinery is properly placing the blank 68 around the forming head 58, the lines 34 or 50 are in alignment with the lines 60 or indicators on the forming head 58. However, when the machinery is not properly placing the blank 68 around the forming head 58, the lines 34 or 50 are not in alignment with the lines 60 or indicators on the forming head 58 and action must be taken to correct any rotation, twisting or torquing occurring in the blank 68 with respect to the forming head 58. The determination of whether or not the lines 34 and 50 are in alignment with the lines 60 or indicators on the forming can be done manually by a human or may be achieved through the use of an optical device or other electronic sensor. In cases where a misalignment develops, the operations of the forming machine can be automatically or manually ceased until the problem is corrected.

Lines 34 and 50 may additionally affect the shape of the sidewall 12. In embodiments where the bottom wall 18 is of a rectangular, polygonal or reuleaux polygonal shape, lines 34 and 50 that are scored, embossed or etched into the panels 14 and 16 are particularly advantageous in shaping the lower end of the sidewall 12. In such embodiments, the lines 34 and 50 ensure that the lower ends of wall panels 14 and 16 are shaped around the bottom panel 18 in order to reduce any gap or space therebetween. As such, the lines 34 and 50 aid the sidewall 12 in generally conforming and wrapping closely around the edges 54 and 56 of the bottom panel, particularly in the corners where the bottom's side edges 54 and 56 converge with the bottom edges 24 and 40 of wall panels 14 and 16.

As yet another quality control measure to ensure that the scoops 10 are being formed in uniform shape with respect to one another, the scoops 10 may comprise marker lines 52 on either or both of the front and rear wall panels 14 and 16. As best illustrated in FIGS. 1 and 2, the marker lines 52 are positioned adjacent the side seams 20. In one embodiment, the marker lines 52 are located on the rear wall panel 16 at the location where the side edges 28 and 30 of the front wall panel 14 meet the rear wall panel 16. As such, the lines 52 can be used to ensure that the intended amount of overlap is achieved between the front and rear wall panels 14 and 16. If too little or too much overlap occurs, the resulting shape of the scoop 10 will be affected. When either one or both of the lines 52 are either spaced apart from or covered by the side edge portion 32 of the front wall panel 14, it indicates that the scoop 10 is not properly formed. When the edge portions 32 of the front wall panel 14 cover both lines 50, it is an indication that there is more overlap between the panels 14 and 16 than intended. Conversely, when both lines 50 are exposed and spaced away from the side edges 28 and 30 of the front wall panel 14, it is an indication that there is less overlap between the panels 14 and 16 than intended. In cases where one line 50 is covered and the other is exposed, the front wall panel 14 may be twisted with respect to the rear wall panel 16.

Turning attention now to the bottom wall panel 18, flaps or tabs 62 may be provided extending from the side edges 54 and 56 of the bottom panel 18. The tabs 62 may join the bottom panel 18 about fold lines 66. One embodiment includes two tabs 62, as depicted in FIG. 5 and another embodiment includes four tabs 62, as shown in FIG. 6. A cut or slit 64 is made adjacent the bottom edges 24 and 40 of the front and rear wall panels 14 and 16 to form the tabs 62.

As demonstrated in FIG. 2, when the scoop 10 is fully formed, the tabs 62 extend upwardly from the bottom wall panel 18. Tabs 62 are in contact with the front and/or rear wall panels 14 and 16, as applicable, and therefore do not require any glue or adhesive to be held in place. The tabs 62 are initially in the same plane as the bottom panel 18 when the blank 68 is cut. As will be appreciated, after the tabs 62 are folded upwardly, they have a tendency to return or spring back down to their natural and initial position which is in the same plane as the bottom panel 18, but are prevented from doing so and are held in place by the wall panels 14 and 16. As such, the tabs 62 press or seat up against the inner surfaces of the wall panels 14 and 16 and, thus, do not require any glue or adhesive to be held in place. When pressed against the wall panels 14 and 16, the tabs 62 generally seal any gap or space between the wall panels 14 and 16 and bottom panel 18 located under the tabs 62.

In another embodiment the tabs 62, rather than being foldably joined to the bottom panel 18, may be foldably joined to the front and rear wall panels 14 and 16. In this embodiment, the tabs 62 can extend inwardly from panels 14 and 18. Like tabs 62 extending from the bottom panel 18, tabs 62 extending from the front and rear wall panels 14 and 16 do not require any glue or adhesive to be held in place.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A one piece container, said container comprising:

a front wall panel having at least one side edge portion;

a rear wall panel having at least one side edge portion in overlapping relationship with said front wall panel side edge portion to form a side seam;

a bottom joined to both said front wall panel and said rear wall panel;

a first line provided on one of said front wall panel and said rear wall panel for indicating a rotational position of said container with respect to a forming head during formation of said container; and an internal tab extending upwardly from a side edge of said bottom, wherein said tab presses against an inner surface of at least one of said front wall panel and said rear wall panel, and wherein said tab is not glued to either said front wall panel or said rear wall panel.

2. A one piece container, said container comprising:

a front wall panel having at least one side edge portion;

a rear wall panel having at least one side edge portion in overlapping relationship with said front wall panel side edge portion to form a side seam;

a bottom joined to both said front wall panel and said rear wall panel; and an internal tab extending upwardly from a side edge of said bottom, wherein said tab presses against an inner surface of at least one of said front wall panel and said rear wall panel, and wherein said internal tab is not glued.

* * * * *